US008770298B2

(12) United States Patent
Gustafson

(10) Patent No.: US 8,770,298 B2
(45) Date of Patent: Jul. 8, 2014

(54) SAFETY MECHANISM FOR BLOWOUT PREVENTER

(75) Inventor: Ryan Gustafson, Cypress, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 804 days.

(21) Appl. No.: 12/608,631

(22) Filed: Oct. 29, 2009

(65) Prior Publication Data

US 2011/0100637 A1 May 5, 2011

(51) Int. Cl.
*E21B 29/12* (2006.01)
*E21B 33/06* (2006.01)

(52) U.S. Cl.
USPC ..... 166/359; 166/85.4; 166/363; 166/364

(58) Field of Classification Search
CPC ..... E21B 41/0021; E04G 1/00; E04G 7/301; E04G 7/302
USPC ..... 166/341, 338, 339, 344, 351, 352, 359, 166/360, 366–368, 378, 381, 85.1, 85.4, 166/363–364; 182/8, 36; 251/1.1
See application file for complete search history.

(56) References Cited

U.S. PATENT DOCUMENTS 4,085,818 A * 4/1978 Swager ..... 182/48
6,425,458 B1 * 7/2002 Soll ..... 182/36
2004/0011592 A1 * 1/2004 Lee et al. ..... 182/187
2008/0302536 A1 * 12/2008 Kotrla et al. ..... 166/341
2010/0012424 A1 * 1/2010 Krauss ..... 182/3

OTHER PUBLICATIONS

Soll products catalog pp. 8, 9 and 16, downloaded from the internet on Apr. 3, 2012.*

* cited by examiner

*Primary Examiner* — James Sayre
(74) *Attorney, Agent, or Firm* — Bracewell & Giuliana LLP

(57) ABSTRACT

Blowout preventer (BOP) stack and lower marine riser package for sealing an undersea well. The blowout preventer stack includes a frame extending along an axis and configured to be attached to a head of the well; an accumulator attached to the frame and configured to provide high pressure; two or more BOPs attached to the frame, the two or more BOPs being disposed within the frame and attached one on top of the other along the axis; each BOP having a body and a pair of bonnets attached to the body, where the bonnets are configured to be detachably attached to the body; each BOP having a corresponding cavity extending along the axis through which a fluid from the well is circulating; each BOP being configured to seal the well when the high pressure from the accumulator is released to the BOPs; plural brackets attached to the body of at least one BOP; and a safety bar attached to the plural brackets and configured to partially encircle the body of the at least one BOP.

13 Claims, 7 Drawing Sheets

SAFETY MECHANISM FOR BLOWOUT PREVENTER

BACKGROUND

1. Technical Field

Embodiments of the subject matter disclosed herein generally relate to methods and systems and, more particularly, to techniques for providing a safety mechanism for a blowout preventer.

2. Discussion of the Background

A subsea blowout preventer ("BOP") stack is used to seal a wellbore during drilling operations, both for safety and environmental reasons. As shown in FIG. 1, a drilling system 10 used for extracting oil and/or gas from under the sea floor may include a lower blowout preventer stack ("lower BOP stack") 14, which may be rigidly attached to a wellhead 16 upon the sea floor 12, while a Lower Marine Riser Package ("LMRP") 18 is retrievably disposed upon a distal end of a marine riser 20, extending from a drill ship 22 or any other type of surface drilling platform or vessel. As such, the LMRP 18 may include a stinger 24 at its distal end configured to engage a receptacle 26 located on a proximal end of the lower BOP stack 14.

In typical configurations, the lower BOP stack 14 may be rigidly affixed atop a subsea wellhead and may include (among other devices) a ram-type blowout preventer (BOP) 28 useful in controlling the well as it is drilled and completed. Similarly, the LMRP 18 may be disposed upon a distal end of a long flexible riser 20 that provides a conduit through which drilling tools and fluids may be deployed to and retrieved from the subsea wellbore. Ordinarily, the LMRP 18 may include (among other things) a ram-type blowout preventer at its distal end such that, when desired, ram-type blowout preventers of the LMRP 18 and the lower BOP stack 14 may be closed and the LMRP 18 may be detached from the lower BOP stack 14 and retrieved to the surface, leaving the lower BOP stack 14 atop the wellhead.

During the operation of the lower BOP stack 14 and/or the LMRP 18, various incidents or simply maintenance events may occur that require access to the BOP 28. For this purpose, the well might be shut down and the part necessary to be worked on may be lifted to the vessel 22. If the equipment necessary for repairing the BOP 28 is not available on the vessel 22, the BOP 28 is shipped to dry locations where the equipment is available. As the BOP 28 is connected to other parts of the lower BOP stack 14 and/or the LMRP 18, which parts may be heavy and linked to the BOP in a complicated manner, it is the practice to remove the whole lower BOP stack 14 and/or LMRP 18 and bring it to the surface for repairs or inspection.

Thus, the weight of the entire lower BOP stack may be in the range of millions of kg and a height of the stack may be up to 10 m. Especially when the repair and/or inspection of the lower BOP stack 14 and/or LMRP 18 is performed on the vessel 22, the sea waves may sometimes tilt these devices so violently that maintenance personnel working around the lower BOP stack 14 and/or LMRP 18 may get injured or even lose their lives.

Accordingly, it would be desirable to provide systems that avoid the afore-described problems and drawbacks.

SUMMARY

According to one exemplary embodiment, there is a blowout preventer (BOP) stack and lower marine riser package for sealing an undersea well. The blowout preventer stack includes a frame extending along an axis and configured to be attached to a head of the well; an accumulator attached to the frame and configured to provide high pressure; two or more BOPs attached to the frame, the two or more BOPs being disposed within the frame and attached one on top of the other along the axis; each BOP having a body and a pair of bonnets attached to the body, wherein the bonnets are configured to be detachably attached to the body; each BOP having a corresponding cavity extending along the axis through which a fluid from the well is circulating; each BOP being configured to seal the well when the high pressure from the accumulator is released to the BOPs; plural brackets attached to the body of at least one BOP; and a safety bar attached to the plural brackets and configured to partially encircle the body of the at least one BOP.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of BOP stacks. However, the embodiments to be discussed next are not limited to these systems, but may be applied to other systems that require the presence of a person at a high height or in an unstable environment, as for example, the LMRP.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
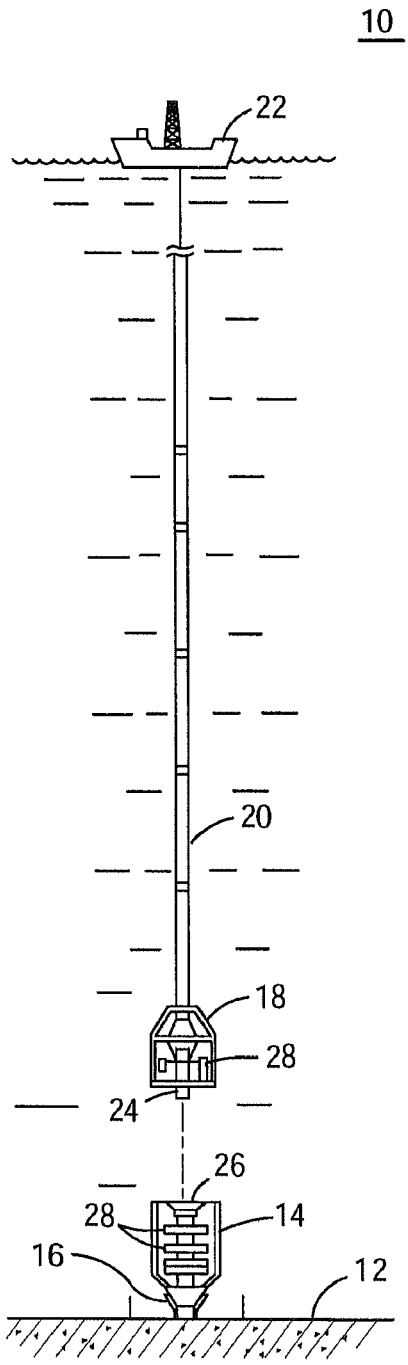
FIG. 1 is a schematic diagram of a conventional offshore rig.
Figure 2:
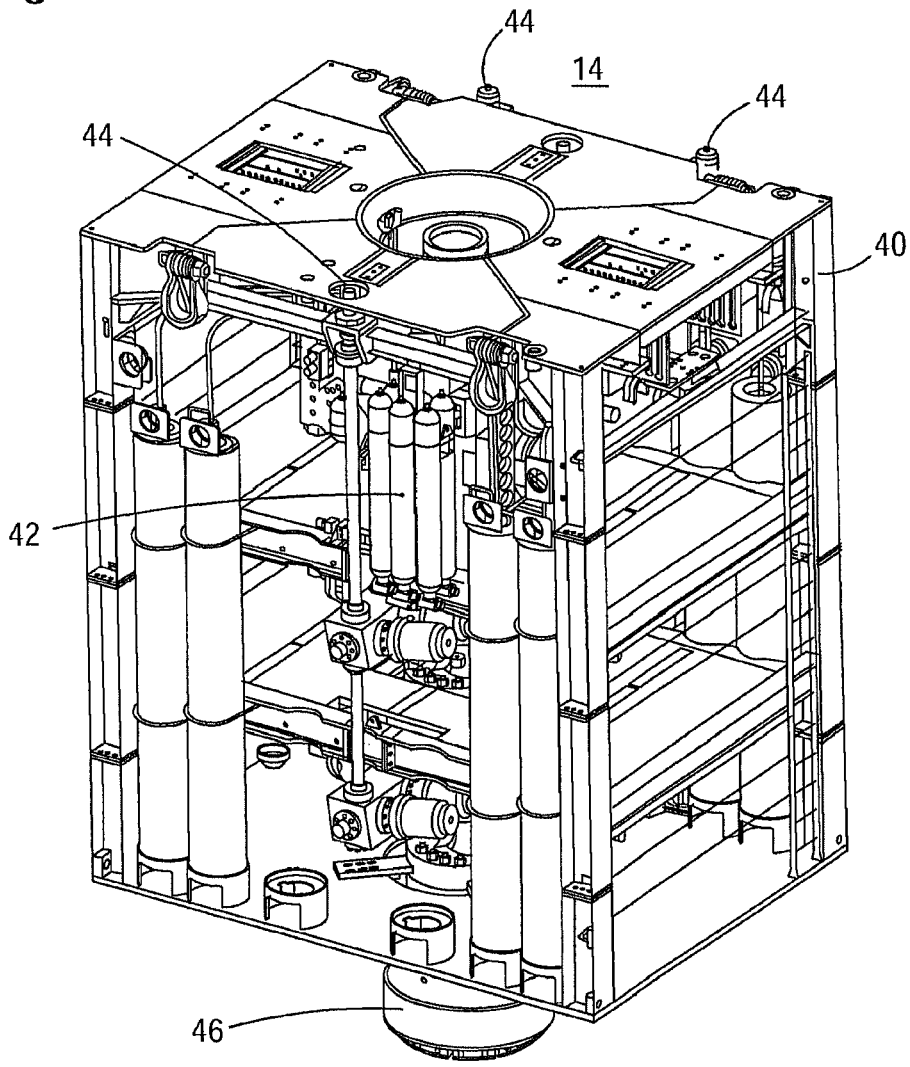
FIG. 2 is a schematic diagram of a lower BOP stack according to an exemplary embodiment.

As discussed above with regard to FIG. 1, the lower BOP stack 14 and/or LMRP 18 may include plural BOPs 28 and other components for performing the undersea drilling. An example of a lower BOP stack 14 is shown in FIG. 2 and the lower BOP stack 14 includes, among other things, a frame 40. The same structure may be used in a LMRP and for this reason only the lower BOP stack 14 is discussed next. The BOPs 28 are not visible in FIG. 2. However, one or more accumulators 42 and plural ports 44 are visible. At the bottom of frame 40 there is a head 46 which is configured to be attached to wellhead 16.

Figure 3:
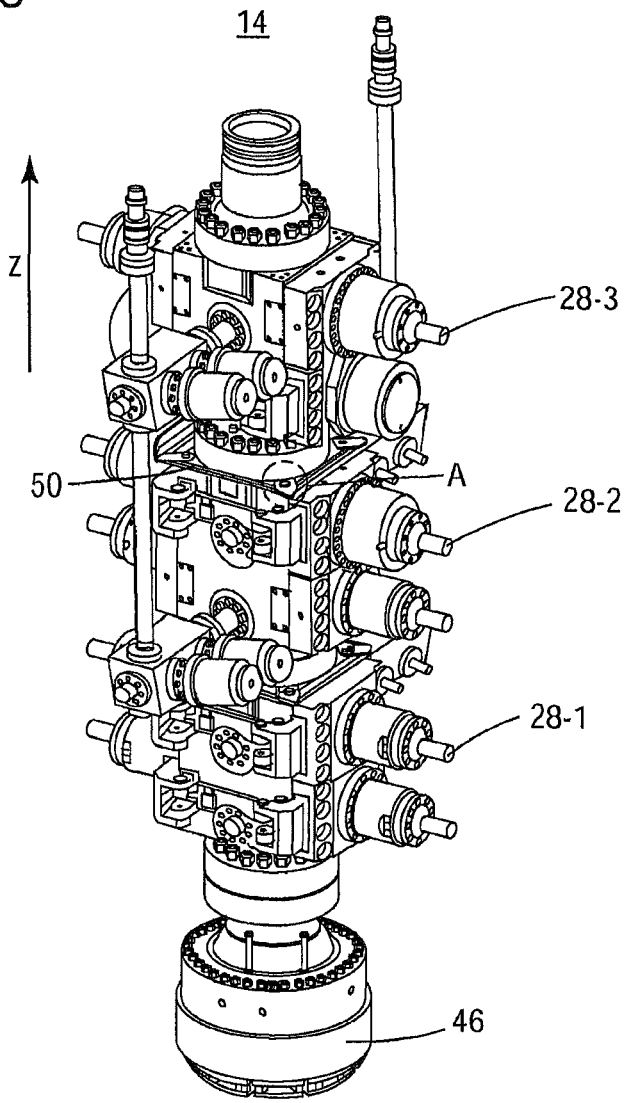
FIG. 3 is a schematic diagram of plural BOPs according to an exemplary embodiment.

A more detailed view of the lower BOP stack 14 is shown in FIG. 3, in which plural BOPs 28-1 to 28-3 are shown assembled on top of each other along an axis Z. Each BOP has a cavity (not shown) extending along the axis Z. A fluid from the well is configured to pass these cavities while being pumped to the vessel. The plural BOPs 28-1 to 28-3 are provided inside frame 40 and they may extend 10 m in height and about 3 m wide. When maintenance to one or more of the BOPs 28-1 to 28-3 is performed, specialized personnel build a scaffold around the lower BOP stack 14 and perform part of the maintenance operations from the scaffold and part of the operations by directly stepping on the BOPs. This approach may be dangerous as the maintenance personnel may slip and/or trip on the BOP, thus potentially falling down from the BOPs. Given the relative high heights of the BOPs, such a fall may be lethal. This danger is further amplified when maintenance is performed on the rig or vessel, which may experience unstable conditions due to motion caused by ocean waves.

Figure 4:
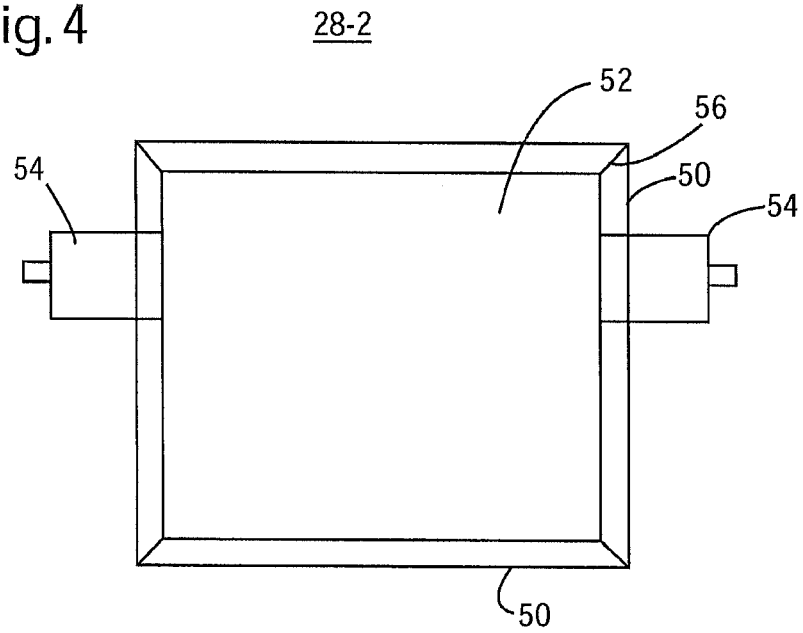
FIG. 4 is a longitudinal cross section through a body of a BOP according to an exemplary embodiment.

According to an exemplary embodiment, at least one BOP 28 of the plural BOPs may be provided with a safety bar 50 that is firmly (permanently) attached to a body of the BOP. Having the safety bar 50 provided around the BOP, the maintenance personnel may attach a safety clip (not shown) to the safety bar 50, thus, securing a harness that is worn by the maintenance personnel to the safety bar 50. For example, the safety bar 50 may be welded, screwed or otherwise attached to the body of the BOP 28-2 as would be recognized by those skilled in the art. According to an exemplary embodiment, the safety bar 50 is provided to completely encircle the body of the BOP 28-2, as shown in FIG. 4. BOP 28-2 is selected as an example but any of the BOPs may be used. FIG. 4 shows the body 52 of the BOP 28-2 having extensions 54 that are configured to accommodate internal movable parts of the BOP, e.g., ram blocks, ram block pistons, etc. The safety bar 50 is attached to the body 52 of the BOP 28-2 via brackets 56. However, according to an exemplary embodiment, the safety bar 50 is provided only partially around body 52 of the BOP 28-2.

Figure 3A:
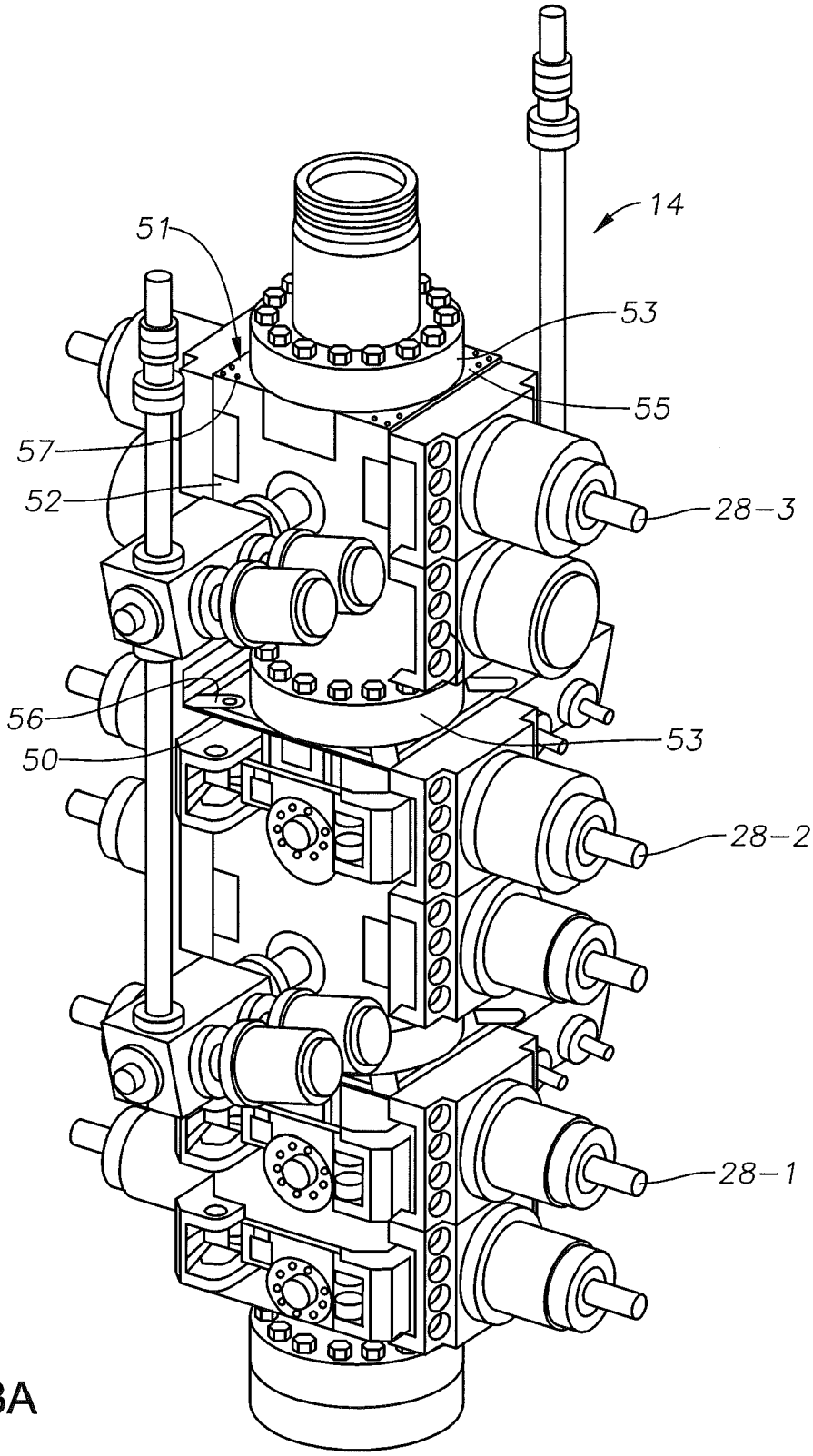
FIG. 3A is an enlarged view of the three BOPs of FIG. 3.

Referring to FIG. 3A, although safety bar 50 is not mounted to the upper BOP 28-3, the upper surface 51 of body 52 of BOP 28-3 is the same as that of middle BOP 28-2. A cylindrical flange 53 of a next upward element bolts to upper surface 51. The cylindrical flange 53 that bolts to upper surface 51 of BOP 28-2 connects BOP 28-2 to upper BOP 28-3. The upper portion of body 52 is rectangular, thus cylindrical flange 53 results in four triangular-shaped upward facing shoulders 55, one at each corner of body 52. Threaded holes 57 are formed in each upward facing shoulder 55.

Figure 5:
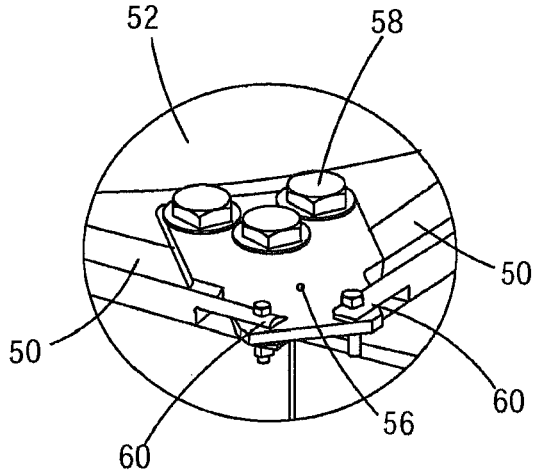
FIG. 5 is a detailed view of a corner of a body of a BOP and a safety bar according to an exemplary embodiment.

A detailed view of a bracket 56, according to an exemplary embodiment, is shown in FIG. 5, which corresponds to detail A in FIGS. 3 and 3A. FIG. 5 shows bracket 56 being fixed by three screws 58 to one of the upward facing shoulders 55 of body 52 of the BOP 28-2. Screws 58 engage the threaded holes 57 (FIG. 3A). The three screws 58 are exemplary and more or less screws may be used. Each bracket 56 extends outward from body 52 a short distance along a radial line of the axis of body 52. The safety bar 50 is fixed to bracket 56 via one or more screws 60. One skilled in the art would recognize that instead of screwing bracket 56 and safety bar 50 to each other and to the body 52 of the BOP, these elements may be welded in place. FIGS. 3 and 4 show four different safety bars 50 attached with four brackets 56 to the body 52 of the BOP 28-2. In one application, less or more safety bars may be used.

Figure 6:
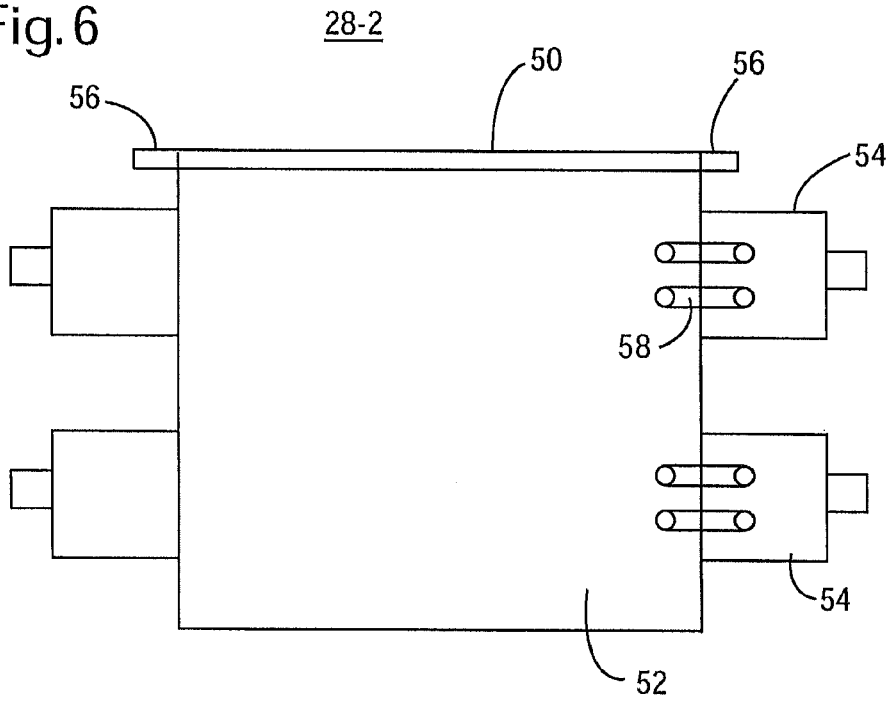
FIG. 6 is a transversal cross section through a body of a BOP according to an exemplary embodiment.

According to an exemplary embodiment shown in FIG. 6, the safety bars 50 are placed on an upper part of the BOP 28-2, such that the safety bars 50 are above the extensions parts 54. One reason for having this placement of the safety bars 50 is to give the maintenance personnel the freedom to work on the extensions parts 54, which are bonnets that need to be removed in order to reach inside the body 52 to the ram blocks. As the bonnets may weight in the range of hundreds of kg, for example, from 100 to 500 kg, the manipulation of these bonnets, which may be attached by hinges 58 to the body 52, may trigger the fall of the maintenance personnel. Having their safety clip attached to the safety bar 50, in the event of an accidental slip off the BOP, the maintenance personnel is still attached to the safety bar 50, thus preventing a dangerous fall.

In addition, the distribution of the safety bar 50 at the top part of the BOP and around the body 52 of the BOP offers the maintenance personnel the freedom to move around the BOP for various maintenance operations. According to another exemplary embodiment, the safety bars 50 may be used to restrain the movement of the maintenance personnel at the periphery of the lower BOP stack 14 while allowing them to work inside the frame 40.

Carbon steel 4130 may be used to produce the safety bars 50. Carbon steel 75 ksi (ksi=1000 psi) tensile strength may be used for 1-, 1.25- and 2.0-inch diameter safety bars, 95 ksi may be used for 1.50 in and 60 ksi may be used for 1.75 in. These dimensions of the safety bar ensures that the bars are configured to withstand a minimum of 5000 lbs per rig personnel.

Figure 7:
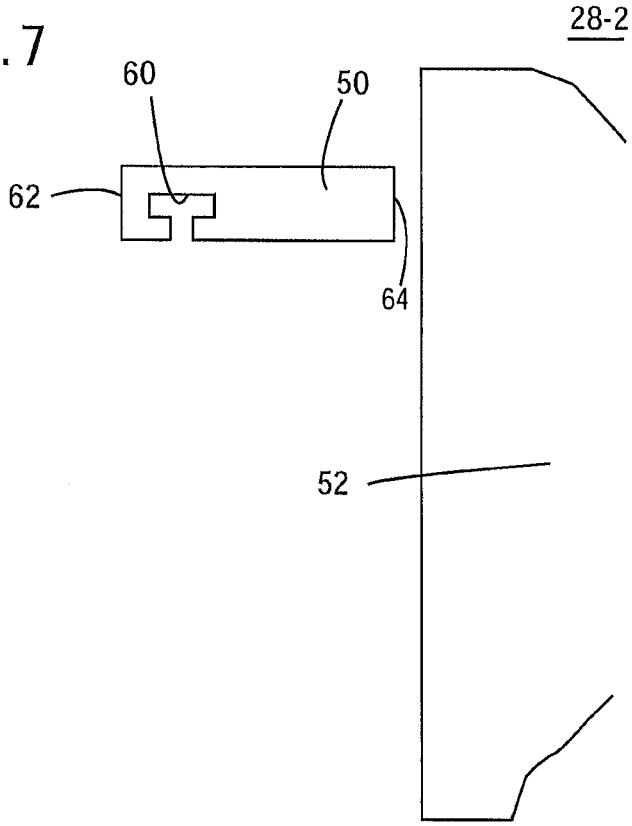
FIG. 7 is a schematic diagram of a safety bar with a t-slot according to an exemplary embodiment.

According to an exemplary embodiment, the safety bar 50 may have a flat band profile having a t-slot 60 machined at a side 62 as shown in FIG. 7. FIG. 7 shows the safety bar 50 disposed with a side 64 next to the body 52 of the BOP 28-2. FIG. 7 is a cross sectional view of the BOP 28-2 through a middle portion of the body 52 such that brackets 56 are not visible. A tie-off ring (not shown) that is attached to a harness strap (not shown) of the maintenance personnel may be provided inside the t-slot 60 for securing the tie-off ring to the safety bar 50. Providing the t-slot 60 into the safety bars 50, all the way around the body 52, ensures that the maintenance personnel is free to move around the BOP 28-2.

Figure 8:
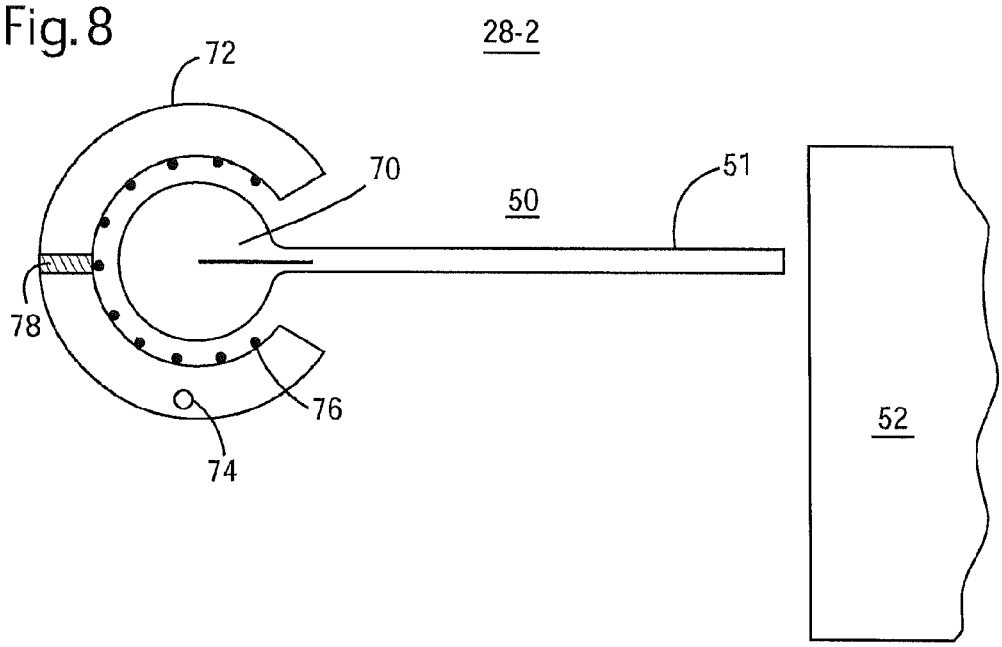
FIG. 8 is a schematic diagram of a safety bar having a spherical profile portion according to an exemplary embodiment.

According to another exemplary embodiment as shown in FIG. 8, the safety bar 50 may have a plate shape portion 51 with a round profile 70 at an end portion. A C-clamp 72 may be provided to encircle the round profile 70 such that the C-clamp 72 cannot detach from the safety bar 50. A tie-off hole 74 may be provided in the C-clamp 72 such that the maintenance personnel may attach their harness to the tie-off hole 74. Optionally, internal bearings 76 may be provided on an internal face of the C-clamp 72 for facilitating a relative motion of the C-clamp 72 relative to the safety bar 50. The C-claim 72 may include a mechanism 78 for opening it when there is a need to remove the clamp from the safety bar 50.

Figure 9:
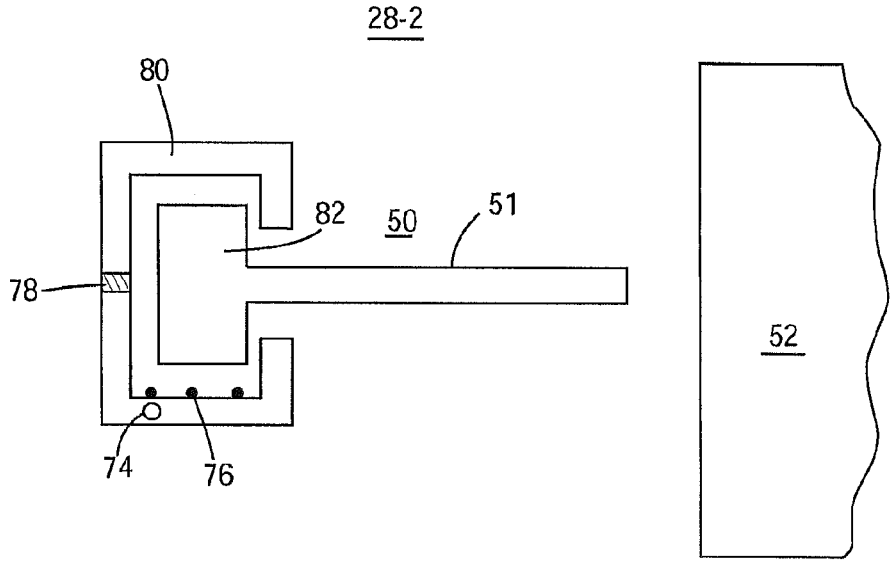
FIG. 9 is a schematic diagram of a safety bar having a rectangular profile portion according to an exemplary embodiment.

According to another exemplary embodiment shown in FIG. 9, the C-clamp 72 may be replaced with a square clamp 80 that slides along a square profile 82 of the safety bar 50. A tie-off hole 74 is provided in a side of the square claim 80 and the internal bearings 76 and mechanism 78 are similar to the embodiment shown in FIG. 8.

The disclosed exemplary embodiments provide a system for increasing the safety of operating personnel when working on a BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other example are intended to be within the scope of the claims.

What is claimed is:

1. A blowout preventer (BOP) stack for sealing an undersea well, comprising:

a frame extending along an axis and configured to be attached to a head of the well;

an accumulator attached to the frame and configured to provide high pressure;

two or more BOPs attached to the frame, the two or more BOPs being disposed within the frame and attached one on top of the other along the axis;

each BOP having a body and a pair of bonnets attached to the body, wherein the bonnets comprise cylindrical extensions protruding laterally from the body and configured to be detachably attached to the body, the body of one of the BOPs having a rectangular upper section defining four corners, and an upward facing shoulder at each of the corners;

each BOP being configured to seal the well when the high pressure from the accumulator is released to the BOPs;

a plurality of brackets, each of the brackets being attached to one of the upward facing shoulders of the body of said one of the BOPs, each of the brackets extending outward past the upward facing shoulder on which it is mounted; and a safety bar attached to the plurality of brackets and configured to surround the axis, the safety bar being located outboard of the rectangular upper section of the body of said one of the BOPs, and the safety bar having side portions extending over the bonnets of said one of the BOPs; and the safety bar being configured to slidingly receive a personnel safety harness fastener.

2. The blowout preventer stack of claim 1, wherein each of the brackets extends from one of the shoulders along a radial line of the axis.

3. The blowout preventer stack of claim 1, wherein the safety bar is attached to a free end of each of the brackets.

4. The blowout preventer stack of claim 1, wherein each of the brackets is secured to one of the upward facing shoulders by bolts extending into threaded holes in the upward facing shoulder.

5. The blowout preventer stack of claim 1, wherein the safety bar has four straight sections, defining a rectangular shape, each straight section extending between two of the brackets.

6. The blowout preventer stack of claim 1, wherein the brackets protrude outward from the upward facing shoulders a distance less than a length of each of the bonnets.

7. The blowout preventer stack of claim 1, wherein the body of said one of the BOPs has a flat upper surface to which a cylindrical flange is bolted, and the brackets are spaced outboard from the cylindrical flange relative to the axis.

8. A blowout preventer stack for sealing an undersea riser that is connected to a well, comprising:

a frame extending along an axis and configured to be attached to a head of the well;

an accumulator attached to the frame and configured to provide high pressure;

a blowout preventer (BOP) disposed within the frame;

the BOP having a body with oppositely facing front and back walls joined by oppositely facing side walls, and a pair of bonnets, each of the bonnets attached to one of the side walls of the body;

the body having a horizontal, flat upper surface;

a cylindrical upward extending flange bolted to the upper surface concentric with the axis;

the BOP being configured to seal the well when the high pressure from the accumulator is released to the BOP;

a plurality of brackets bolted to the upper surface of the body and spaced radially outward from the flange, each of the brackets having a free end located outward from the body, the brackets being spaced around the axis; and a safety bar attached to the free ends of the brackets, the safety bar having front and back portions spaced outward from the front and back walls, respectively, and side portions spaced outward from the side walls and above the bonnets.

9. The blowout preventer stack of claim 8, wherein the safety bar has a rectangular configuration with each of the front, back and side portions being straight.

10. The blowout preventer stack of claim 8, wherein two of the brackets are located at corners between the front wall and each of the side walls, and two of the brackets are located at corners between the back wall and each of the side walls.

11. The blowout preventer stack of claim 8, wherein each of the brackets extends along a radial line of the axis.

12. The blowout preventer stack of claim 11, wherein the free ends of the brackets are located closer to the body than a length of the bonnets.

13. A blowout preventer (BOP) stack, comprising:

a plurality of BOPs fastened on top of each other along an axis;

one of the BOPs having a body with a generally rectangular upper surface, a front wall, a back wall, and two oppositely facing side walls;

a cylindrical flange bolted to and extending upward from the upper surface of the body, defining upward facing shoulders on the upper surface of the body extending radially outward from the flange;

a plurality of brackets, each secured by bolts to one of the upward facing shoulders of the body, each of the brackets protruding outward from the body; and a safety bar attached to each of the brackets for receiving a clip of a personnel safety harness, the safety bar having a front portion located a selected distance outward from the front wall, a back portion located a selected distance outward from the back wall, and two side portions, each located a selected distance outward from one of the side walls.

* * * * *